US009382775B2

(12) United States Patent
Travis et al.

(10) Patent No.: US 9,382,775 B2
(45) Date of Patent: Jul. 5, 2016

(54) WELLHEAD CONTROL LINE DEPLOYMENT

(71) Applicant: Weatherford/Lamb, Inc., Houston, TX (US)

(72) Inventors: Todd Travis, Humble, TX (US); Eric Calzoncinth, Baytown, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 220 days.

(21) Appl. No.: 13/922,678

(22) Filed: Jun. 20, 2013

(65) Prior Publication Data

US 2013/0284456 A1 Oct. 31, 2013

Related U.S. Application Data

(62) Division of application No. 12/779,544, filed on May 13, 2010, now Pat. No. 8,479,828.

(51) Int. Cl.

| | |
|---|---|
| ***E21B 33/072*** | (2006.01) |
| ***E21B 33/04*** | (2006.01) |
| ***E21B 33/047*** | (2006.01) |

(52) U.S. Cl.

CPC ..... *E21B 33/047* (2013.01); *E21B 33/0407* (2013.01); *E21B 33/072* (2013.01); *E21B 33/04* (2013.01)

(58) Field of Classification Search

CPC . E21B 33/0407; E21B 33/072; E21B 33/068; E21B 33/04; E21B 34/02; E21B 33/0355

See application file for complete search history.

(56) References Cited

U.S. PATENT DOCUMENTS

| | | | | |
|---|---|---|---|---|
| 3,494,417 | A | 2/1970 | Fredd | |
| 3,661,206 | A | 5/1972 | Putch et al. | |
| 3,739,846 | A * | 6/1973 | Beson | 166/89.2 |
| 3,910,352 | A | 10/1975 | Mott | |

(Continued)

FOREIGN PATENT DOCUMENTS

| | | |
|---|---|---|
| CA | 2310236 | 12/2001 |
| EP | 0637675 | 2/1995 |

(Continued)

OTHER PUBLICATIONS

Search Report for Application No. GB0904319.1, dated Sep. 13, 2010.

(Continued)

*Primary Examiner* — Blake Michener
*Assistant Examiner* — Kipp Wallace
(74) *Attorney, Agent, or Firm* — Blank Rome, LLP

(57) ABSTRACT

Wellhead control line deployment involves replacing the seat/retainer plate of a master valve of the wellhead with a modified retainer plate. The retainer plate defines a first port communicating from a central opening of the plate to outside the plate. A modified bonnet installs on the master valve, and the bonnet has two ports, one communicating with the first port in the retainer plate and the second communicating with a needle valve port. The communication ports are linked by a tube with outside diameter seals that inserts between the retainer plate and the bonnet. A control line hanger can be retained by locking into an adapter sleeve or directly in the back-pressure valve threads of a tubing hanger. The adapter sleeve can be attached to the retainer plate or have a collet to snap into the back-pressure valve threads of the tubing hanger.

18 Claims, 7 Drawing Sheets

(56) References Cited

U.S. PATENT DOCUMENTS

| | | | | |
|---|---|---|---|---|
| 4,691,776 | A | 9/1987 | Pringle | |
| 4,804,045 | A * | 2/1989 | Reed | 166/65.1 |
| 4,836,287 | A | 6/1989 | Eric et al. | |
| 5,092,400 | A | 3/1992 | Jagert | |
| 5,094,294 | A | 3/1992 | Bayh, III | |
| 5,148,865 | A | 9/1992 | Reed | |
| 5,203,409 | A | 4/1993 | Seid et al. | |
| 5,305,828 | A | 4/1994 | White et al. | |
| 5,358,053 | A | 10/1994 | Akkerman | |
| 5,361,834 | A | 11/1994 | Cox | |
| 5,662,169 | A | 9/1997 | Hosie | |
| 5,722,844 | A | 3/1998 | Schraeder | |
| 5,727,631 | A | 3/1998 | Baker et al. | |
| 5,865,255 | A | 2/1999 | Hammett et al. | |
| 6,227,300 | B1 | 5/2001 | Cunningham et al. | |
| 6,289,993 | B1 | 9/2001 | Dallas | |
| 6,357,529 | B1 | 3/2002 | Kent et al. | |
| 6,688,386 | B2 | 2/2004 | Cornelssen et al. | |
| 6,715,554 | B1 | 4/2004 | Cunningham et al. | |
| 6,851,478 | B2 | 2/2005 | Cornellessen et al. | |
| 6,966,383 | B2 | 11/2005 | Milberger et al. | |
| 7,025,132 | B2 | 4/2006 | Kent et al. | |
| 7,040,409 | B2 | 5/2006 | Sangla | |
| 2002/0000315 | A1 | 1/2002 | Kent et al. | |
| 2002/0011336 | A1 | 1/2002 | Baskett et al. | |
| 2002/0134548 | A1 | 9/2002 | Lam et al. | |
| 2003/0019631 | A1 | 1/2003 | DeBerry | |
| 2004/0079532 | A1 | 4/2004 | Allen et al. | |
| 2004/0112604 | A1 | 6/2004 | Milberger et al. | |
| 2004/0154790 | A1 | 8/2004 | Cornelssen et al. | |
| 2004/0262010 | A1 | 12/2004 | Milberger | |
| 2007/0056747 | A1 | 3/2007 | Jacob | |
| 2008/0029271 | A1 | 2/2008 | Bolding et al. | |
| 2008/0156478 | A1 | 7/2008 | Broussard | |
| 2008/0169097 | A1 | 7/2008 | Bolding et al. | |
| 2009/0000781 | A1 | 1/2009 | Bolding | |
| 2009/0255682 | A1 | 10/2009 | Voss et al. | |
| 2009/0294134 | A1 | 12/2009 | Jones et al. | |
| 2009/0294135 | A1 | 12/2009 | Jacob et al. | |
| 2009/0294136 | A1 | 12/2009 | Jones et al. | |
| 2010/0078176 | A1 | 4/2010 | Christie | |
| 2010/0170679 | A1 | 7/2010 | Borak | |
| 2011/0290507 | A1 * | 12/2011 | Stewart et al. | 166/385 |

FOREIGN PATENT DOCUMENTS

| | | | |
|---|---|---|---|
| FR | 2734863 | A1 | 12/1996 |
| GB | 1419850 | | 12/1975 |
| GB | 2287270 | | 9/1995 |
| GB | 2377954 | | 1/2003 |
| GB | 2421750 | | 7/2006 |
| GB | 2443083 | | 4/2008 |
| WO | 9904137 | | 1/1999 |
| WO | 2005008025 | | 1/2005 |
| WO | 2006034214 | | 3/2006 |
| WO | 2006/133351 | A2 | 12/2006 |
| WO | 2008/089038 | | 7/2008 |
| WO | 2008/016663 | A2 | 8/2008 |

OTHER PUBLICATIONS

Search Report for Application No. GB0904319.1, dated Sep. 10, 2010, claims searched 17-22.
Search Report for Application No. GB0904319.1, dated Sep. 10, 2010, claims searched 23-30.
Search Report for Applicaiton No. GB0904319.1, dated Sep. 10, 2010, claims searched 31-35.
UK Search Report dated Nov. 26, 2010 for Application No. GB1019049.4, 3 pages.
Supplemental UK Examination Report for corresponding appl. GB0904319.1, dated Jan. 31, 2011, 3-pgs.
Office Action in U.S. Appl. No. 12/128,811, mailed Oct. 29, 2010.
Response to Office Action of Oct. 29, 2010 in U.S. Appl. No. 12/128,811, mailed Feb. 2, 2011.
Office Action in U.S. Appl. No. 12/128,811, mailed Apr. 15, 2011.
Response to Office Action of Apr. 15, 2011 in U.S. Appl. No. 12/128,811, filed Jul. 13, 2011.
Office Action in U.S. Appl. No. 12/408,527, mailed Jun. 24, 2011.
Response to Office Action of Jun. 24, 2011in U.S. Appl. No. 12/408,527.
Final Office Action in U.S. Appl. No. 12/128,811, mailed Aug. 3, 2011.
Response to Final Office Action of Aug. 3, 2011 in U.S. Appl. No. 12/128,811, filed Sep. 2, 2011.
Notice of Allowance in U.S. Appl. No. 12/128,811, mailed Sep. 16, 2011.
Canadian Office Action from Appl. No. 2,696,583, dated Aug. 8, 2011.
Notice of Allowance in U.S. Appl. No. 12/408,527, mailed Dec. 7, 2011.
Select Energy Systems, "Model 2500R Flanged CT Hanger," undated, obtained from http://www.selectsi.com/select_energy/PDFs/01.pdf, 1-pg.
Select Energy Systems, "Model 2500 Flanged CT Hanger." undated, obtained from http://www.selectsi.com/select_energy/PDFs/04.pdf, 1-pg.
Select Energy Systems, "Installation Procedure: Model 2500 CT Hanger," undated, obtained from http://www.selectsi.com/select_energy/PDFs/02.pdf, 2-pg.
PEDCOR, "Series 10-400 Chemical Injector Adapter," dated Jan. 5, 1995, 1-pg.
PEDCOR, "RF Hanger from PEDCOR Inc in Houston, Texas which designs and manufactures coiled tubing tools, downhole tools, wellhea . . . ," generated on Apr. 32, 2006, obtained from http://www.pedcor.com/wellhead-equipment/rf_hanger.html, 3 pgs.
PEDCOR, "Wellhead Equipment Sub: Standard Hanger," generated on Apr. 21, 2006, obtained from http://www.pedcor.com/wellhead-equipment/standard_mandrel_hanger.html, 3-pgs.
PEDCOR, "Conventional DHSV Coiled Tubing Completion from PEDCOR Inc in Houston, Texas which designs and manufactures coiled . . . ," generated on Apr. 21, 2006, obtained from http://pedcor.com/wellhead-equipment/conventional_dhsv_ct_completion.html Apr. 21, 2006, 3-pgs.
ARRAY, "API 6A Gate Valves: Manufacturers and distributors of high quality gate valves for wellhead, manifold, distribution and fracture applications." obtained from www.arrayproducts.com (c) 2007, Document # BR-020-10 Rev B.
Bolding, "Damaged Control Line Replacement Safety Valve System: Thru Tubing," generated on Feb. 2, 2010, obtained from http://onepetro.org/mslib/servlet/onepetropreview?id=SPE-121407-MS&soc=SPE.
Wellhead Distributors Int'l, "Wellhead Housing: WC-22 Casing Spools," undated.
Klompsma, "The Development of a System to Restore Full Safety Valve Functionality to Wells with Blocked and Damaged Control Line," (c) 2009 Society of Petroleum Engineers, SPE 123757, 10 pgs.
Oilenco, "Tubing Hanger Plug," (c) 2009, obtained from www.oilenco.com, 7 pgs.
American Completion Tools, "Flanged Gate Valve Part List," generated on Mar. 12, 2010, obtained from http://www.americancompletion tools.com/wellhead-x-mastree-gatevalves-manifolds/.
American Completion Tools, "Slab Gate Valve Part List," generated on Mar. 12, 2010, obtained from http://www.americancompletion tools.com/wellhead-x-mastree-gatevalves-manifolds/.
Weatherford, "Real Results: New Valve for Damaged Control Lines Saves Operator Millions on Workover Costs," (c) 2008, obtained from www.weatherford.com, 1 pg.
Weatherford, "Renaissance Systems: Revive wells at a fraction of the cost of workovers with Weatherfords unique safety-valve innovations," (c) 2009, obtained from www.weatherford.com, 20 pgs.
Weatherford, "Real Results: Renaissance WDCL System Helps Shell NAM Increase Production, Avoid Costly Workover on Offshore North Sea Well," (c) 2009 obtained from www.weatherford.com.
Weatherford, :Real Results: Renaissance WDCLP System Enables Major Operator to Avoid Costly Workover on North Sea Well for Savings of £5 Million, (c) 2010 obtained from www.weatherford.com, 2 pgs.

(56) References Cited

OTHER PUBLICATIONS

Wellhead Distributors Int'l, "Wellhead Housing: TCM Tubing Spools," undated.
Combined Examination and Search Report in counterpart U.K. Appl. No. GB0904319.1, dated Aug. 10, 2009, 3pgs.
Office Action in co-pending U.S. Appl. No. 12/128,790, dated Sep. 14, 2009.
Reply to Office Action of Sep. 14, 2009 in co-pending U.S. Appl. No. 12/128,790, filed Dec. 14, 2009.
"Thru-Tubing Intervention: PB Packer," Weatherford International Ltd. (c) 2006.
"Thru-Tubing Intervention: GP Gravel-Pack System," Weatherford International Ltd. (c) 2006.
"Thru-Tubing Packers: ER Packer," Weatherford International Ltd. (c) 2008.
"Thru-Tubing Packers: WidePak(TM) Packer," Weatherford International Ltd. (c) 2008.
Combined Examination and Search Report in counterpart UK Appl. No. GB0904319.1, dated Aug. 10, 2009, 3 pgs.

* cited by examiner

WELLHEAD CONTROL LINE DEPLOYMENT

CROSS-REFERENCE TO RELATED APPLICATIONS

This is a divisional of U.S. application Ser. No. 12/779,544, filed 13 May 2010, which is incorporated herein by reference in its entirety.

BACKGROUND

Operators in modern field development may encounter a significant problem when a surface control subsurface safety valve (SCSSV) stops functioning. In some cases, the control line to the safety valve may become blocked or damaged. When the hydraulic pressure is lost, the safety valve closes so that production from the well stops.

Currently, operators have two traditional solutions for dealing with a blocked or damaged control line. In one approach, operators may perform a full-scale workover by pulling tubing and replacing the inoperable control line to restore function to the valve. In another approach, operators can install a velocity or dome charged subsurface controlled subsurface safety valve (SSCSSV) downhole. Unfortunately, such a safety valve may not meet integrity requirements for the well and can also reduce production.

Regulatory requirements and concerns over potential blowout have prompted operators to work over the well rather than deploying such velocities valves. As expected, working over a well can be time consuming and expensive. Therefore, operators would prefer to deploy a surface controlled safety valve in the tubing of the well without having to workover the well.

To overcome these problems, an additional solution allows operators to install a safety valve and alternate control line without the expense of a workover. The Weatherford Damaged Control Line (WDCL) Safety Valve installs in a well using wireline and capillary string techniques. Details related to this safety valve and how it is deployed with a new control line are disclosed in U.S. Pat. Pub. Nos. 2009/0294134, 2009/0294135, and 2009/0294136, which are each incorporated herein by reference in their entireties.

This safety valve has dual packing elements that isolate the old control line entry port in the downhole landing nipple. A control line hanger installs at the wellhead. The control line hanger carries the weight of the control line and provides a conduit for the control line fluid through the wellhead into the control line and to the safety valve. In one technique, operators hot tap the wellhead to hydraulically connect with the control line hanger. From the hanger, the control line for the safety valve connects from the hanger and runs inside the tubing, and a wet connect system connects the control line to the downhole safety valve.

Although the safety valve, control line, and hanger of this system are effective, operators must continually deal with different types of wellhead configurations. Therefore, operators are always striving for additional solutions so a control line can be run from an existing wellhead downhole to a tool needing hydraulic control.

The subject matter of the present disclosure is directed to overcoming, or at least reducing the effects of, one or more of the problems set forth above.

SUMMARY

Control line hanger arrangements allow operators to deploy a control line through an existing wellhead so the control line can communicate hydraulic fluid with a safety valve or other hydraulic tool downhole. After the hydraulic tool has been deployed downhole, operators connect a control line hanger to a control line and run the control line downhole to the tool. The control line hanger installs in the wellhead to support the control line at the wellhead, and a female connector on the end of the control line mates with a male connector on the downhole safety valve.

In one arrangement, a spool installs on the wellhead, and the control line hanger lands on a shoulder in the spool. A cross-port in the spool can then communicate with an inlet on the control line hanger to communicate hydraulic fluid with the control line suspended from the hanger. For its part, the hanger is retained by lock screws.

In another arrangement, the existing master valve of the wellhead is replaced with one having a cross-port and lock screw. The control line hanger can install in the replacement master valve, and the lock screw can hold the hanger in place. The valve's cross-port can then communicate with the inlet on the hanger so hydraulic fluid can communicate downhole through the control line.

In another arrangement, a sleeve can insert in a tubing hanger in the wellhead to support the control line hanger. The sleeve has a snap collet on one end that fits into the back pressure valve thread of the tubing hanger. This allows the sleeve to be installed using a wireline unit without having to rotate and thread it into the tubing hanger. Internally, the sleeve has a lock profile so spring-biased dogs on the control line hanger can engage in the lock profile to hold the hanger in place.

The sleeve can be a unitary piece having a fixed size. Alternatively, the sleeve can have two or more pieces stacked together so that its overall stack height can be altered. For example, the sleeve can have an end piece with the lock profile, another end piece with the snap collet, and an intermediate piece. Operators in the field can cut the length of the intermediate piece in the field to adjust the overall height of the sleeve as needed. Rather than use a sleeve landed in the tubing hanger, another arrangement can use a sleeve that attaches from the replacement plate in the master valve.

In the arrangements using sleeves, a modified or replacement retainer plate installs in the master valve. The plate has a cross-port for communicating with an inlet port on the end of the control line hanger. A modified or replacement bonnet on the master valve connects a source of hydraulic fluid to the cross-port for communicating hydraulic fluid to the suspended control line.

These and other arrangements are disclosed herein. The foregoing summary is not intended to summarize each potential embodiment or every aspect of the present disclosure.

DETAILED DESCRIPTION

Figure 1:
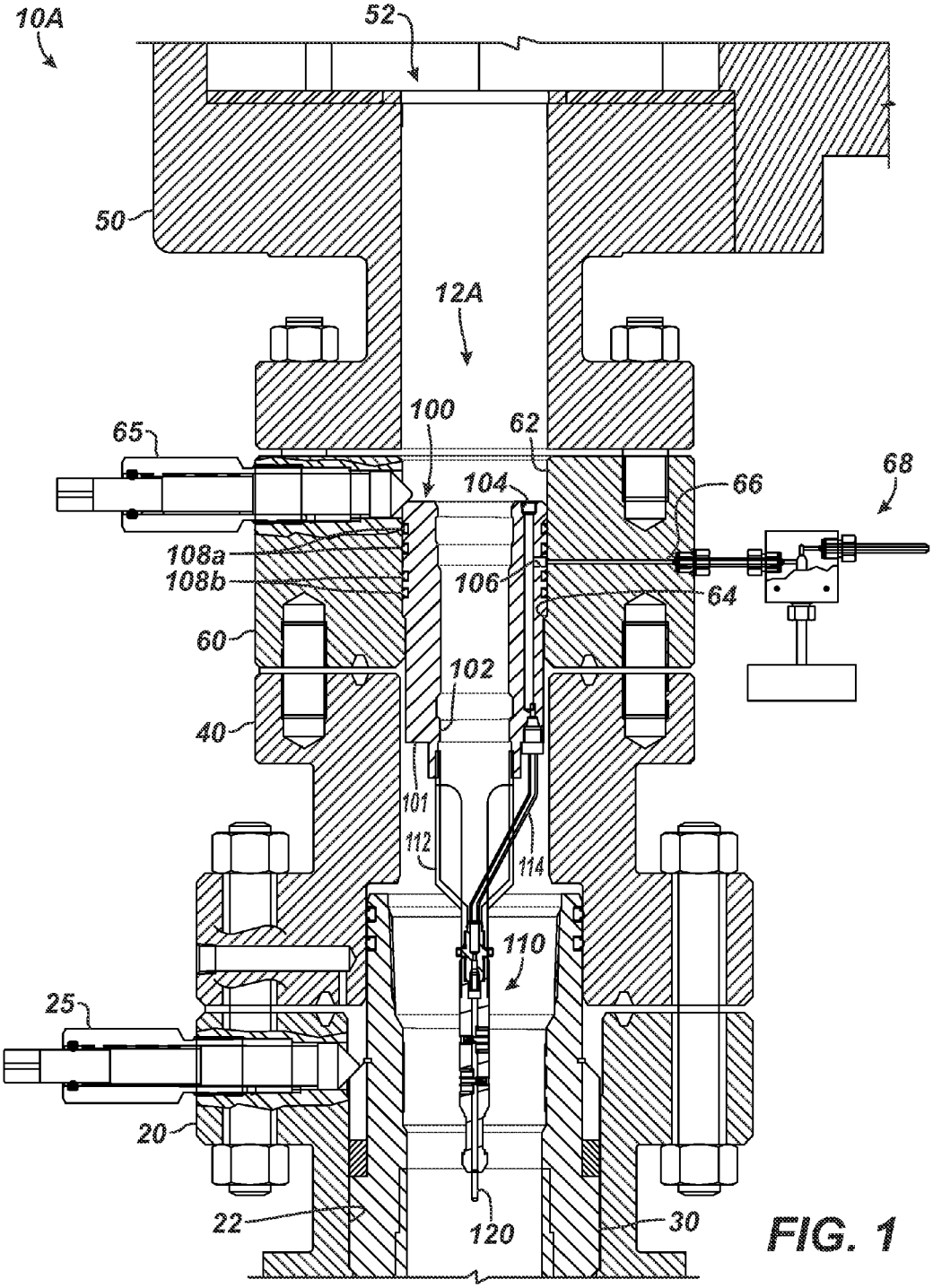
FIG. 1 illustrates a control line hanger arrangement for deploying a control line without the need to hot tap wellhead components.

A wellhead 10A in FIG. 1 includes a tubing spool 20 having a tubing hanger 30 landed therein and retained by lock screws 25. A head adapter 40 attaches to the tubing spool 20 and seals against the top end of the tubing hanger 30. Typically, above the tubing hanger 30, the wellhead 10A has upper and lower master valves, which can be gate valves. Above these, the wellhead 10A typically has a flow tee with a flow line gate valve and a kill line gate valve connected to piping and additional components.

During operations, an existing capillary string or control line (not shown) for the well may become clogged, broken, or otherwise become inoperable. In such a circumstance, operators need to run a new capillary string 120 downhole. As shown, a hanger arrangement 12A supports the capillary string 120 in the wellhead 10A.

The capillary string 120 can be an injection line for deployment downhole. Alternatively, the capillary string 120 can be a control line for a downhole valve, such as a surface-controlled subsurface safety valve or other hydraulically activated tool. One suitable example of such a valve is the Weatherford Damaged Control Line (WDCL) Safety Valve available from the Assignee of the present disclosure. Although capillary string and control line are interchangeable as used herein, the capillary string 120 is referred to as a control line for consistency, but it could be used for other purposes.

Before running the new control line 120, operators need to change components of the wellhead 10A and run the new safety valve downhole. This may require operators to set various plugs and back pressure valves and perform other steps known in the art. Then, the hanger arrangement 12A allows operators to run the control line 120 downhole so hydraulic fluid at the wellhead 10A can communicate with the control line 120 without the need to hot tap components of the wellhead 10A. In the current arrangement 12A, operators remove the Christmas tree (e.g., master valve 50 and the like) of the wellhead 10A above the tubing spool 20 and the head adapter 40. Then, operators install an adapter spool 60 onto the head adapter 40. The Christmas tree including the lower master valve 50 are then re-installed on the adapter spool 60.

Because the control line 120 may be used to hydraulically control a downhole safety valve, it is preferred that the control line 120 not pass through either of the master valves on the wellhead 10A. For this reason, the control line 120 is supported in the through-bore of the wellhead 10A below the lower master valve 50. In this way, should either master valve typically used on the wellhead 10A need to be closed, the control line 120 will not be severed.

Internally, the adapter spool 60 has a shoulder or landing 64 in its internal bore 62. A cross-port 66 passes from an outlet at the spool's internal bore 62 to an inlet at the outside of the spool 60. At this inlet, a valve 68 and communication line affix for communicating hydraulic fluid to the cross-port 66. A needle valve (not shown) intersects the cross-port 66 just before the fitting on the outside diameter of the adapter spool 60 to provide a second barrier for the communication path.

Operators rig up a capillary string spool, lubricator, and other components on the wellhead 10A and lower the new control line 120 downhole. This new control line 120 has a female wet mate connector (not shown) on its distal end. Downhole, the safety valve can have a male section of a wet mate connector. Details related to such a connection and to a subsurface safety valve are disclosed in co-pending application Ser. Nos. 12/128,790; 12/128,811; and 12/408,527, which are incorporated herein by reference in their entireties.

As the control line 120 lowers, a loss in weight observed from the deployed control line 120 indicates that the wet mate connectors have latched. Operators then disconnect and reconnect the wet mate connector to ensure proper latching. At the surface, operators then determine a point on the control line 120 where it will be supported in the wellhead 10A. The control line 120 is then pulled to unlatch the wet mate connectors so the proper point on the control line 120 can be accessed and cut.

Operators then make up the end of the control line 120 to the control line hanger 100 so the control line 120 can be run downhole and supported in the wellhead 10A by the hanger 100. As shown, the end of the control line 120 attaches to the control line hanger 100 with a wet mate connector 110 supported by a fluted connector 112 connected on the end of the hanger 100. The wet mate connector 110 communicates via an ancillary line or line 114 to a passage 104 in the body 101 of the hanger 100.

So as not to obstruct fluid flow in the wellhead 10A, the hanger's body 101 is tubular and defines an internal bore 102 therethrough. Profiles can be provided in the bore 102 for deploying and retrieving the hanger 100. As shown, the passage 104 for hydraulic fluid passes through the sidewall of this tubular body 101. At the side of the body 101, the passage 104 has an inlet or cross-port 106 for communicating with the cross-port 66 on the spool 60. At the lower end of the body 101, the passage 104 has an outlet for communicating with the wet mate connector 110 via the ancillary line 114. (The top end of the passage 104 can be capped off).

Rather than obstruct the body's internal bore 102, the fluted connector 112 extends down from the end of the tubular body 101 and hold the connector 110 centrally below the body 101. Spaces or gaps between the flutes of the connector 112 can allow fluid flow to pass therethrough.

After connecting the control line 120 to the hanger 100, operators rig up a slick line unit and land the control line hanger 100 in the spool 60. An indication that the wet mate connectors have latched downhole prior to landing the hanger 100 can be noted on a weight indicator. To land the hanger 100, the shoulder of the hanger 100 engages on the landing 64 in the spool 60. Once landed, operates engage one or more lock screws 65 against the upper end of the hanger 100 to lock it in place.

Once installed, the hanger's cross-port 106 communicates with the spool's cross-port 66, and seals 108*a-b* on the hanger 100 seal against the spool's bore 62. This new communication path allows operators to apply hydraulic pressure from the valve 68 and communication line and through the cross-port 66 in the spool 60. At the outlet of the port 66 in the spool's bore 62, the hydraulic fluid communicates with the inlet port on the hanger 100, passes through passage 104, and eventually to the control line 120. At this point, the new control line 120 can be used to operate the downhole safety valve.

The hanger arrangement 12A can be used to fit almost any conventional wellhead, and the master valve 50 does not need to be modified. Because the spool 60 must be inserted into the wellhead 10A, the Christmas tree of the wellhead 10A must be removed to perform the installation. Additionally, the stack height of the wellhead 10A changes so that flow lines connected to the wellhead 10A may need to be reconfigured. In some implementations, removing the Christmas tree and changing the wellhead's stack height may not be preferred. In such an instance, another control line hanger arrangement disclosed herein may be used.

Figure 2:
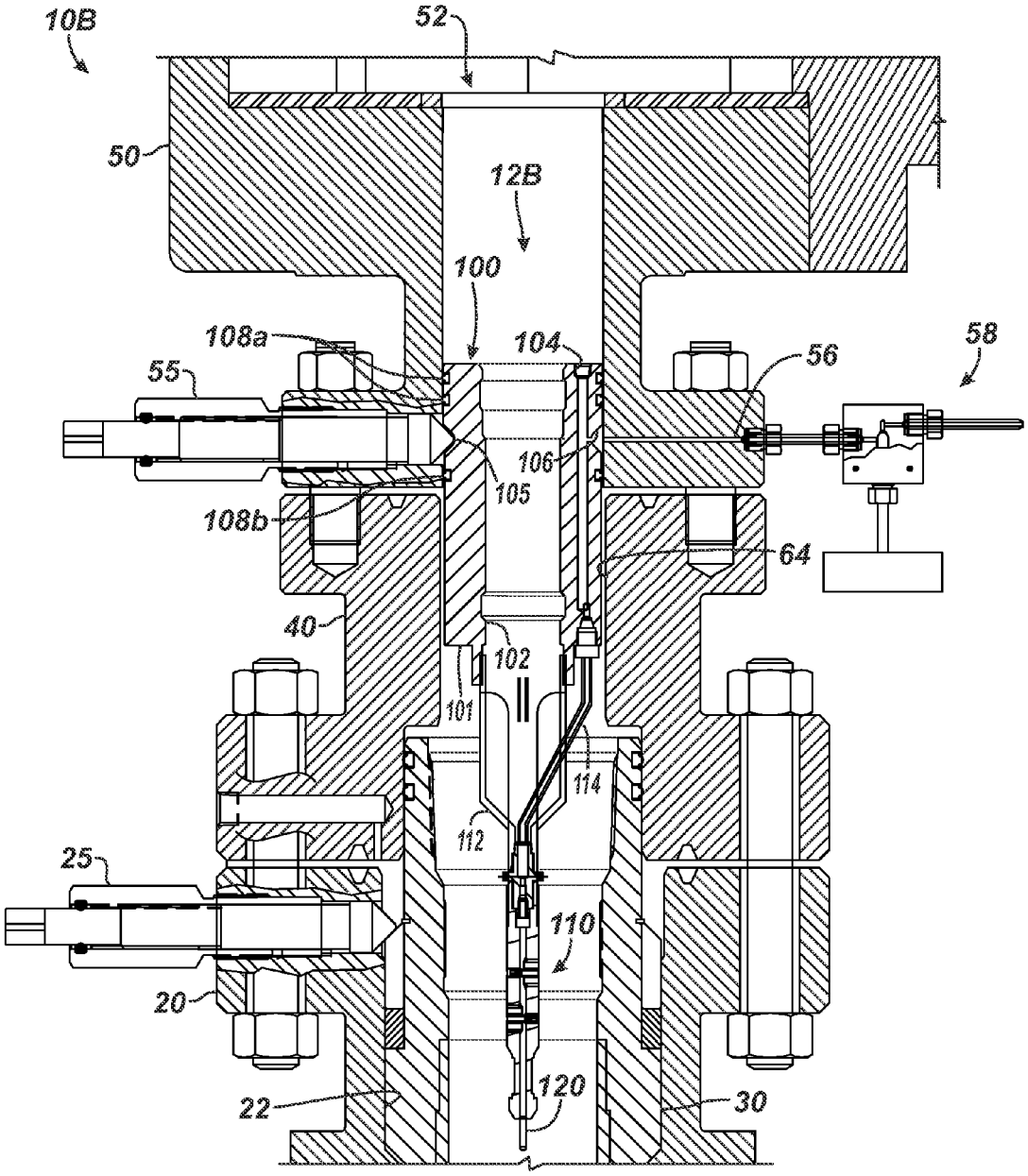
FIG. 2 illustrates another control line hanger arrangement where wellhead components do not need to be hot tapped.

Turning to FIG. 2, another wellhead 10B has a control line hanger arrangement 12B for deploying a control line 120 without the need to hot tap components or change the stack height of the wellhead 10B. Again, the wellhead 10B has the tubing spool 20 with the tubing hanger 30 landed therein and retained by lock screws 25. The head adapter 40 attaches to the tubing spool 20 and seals against the top end of the tubing hanger 30, and the master valve 50 attaches above the head adapter 40.

When a new control line 120 must be installed downhole for the various reasons outline previously, operators remove components of the wellhead 10B above the tubing spool 20 and the head adapter 40. Rather than using a spool as in the previous arrangement, operators install a replacement master valve 50 onto the head adapter 40 to support a control line hanger 100 therein. In this way, the original stack height of the wellhead 10B does not need to be changed so that flow lines do not need to be reconfigured.

This replacement master valve 50 defines a cross-port 56 extending from the valve's 50 internal bore 52 to outside the valve's body 50. As shown herein, the cross-port 56 is defined in the flange of the valve 50, although it could be defined elsewhere. A block valve 58 and communication line connect to the port 56 outside the valve 50 so that hydraulic fluid can be communicated to the cross-port 56. A needle valve (not shown) preferably intersects from the outside diameter of the flange to the cross-port 66 as a second barrier.

As before, the new control line 120 attaches to the control line hanger 100 with a wet mate connector 110 and ancillary line 114 so that the control line 120 can be run downhole and supported in the wellhead 10B by the hanger 100 as described previously. Again, the hanger's body 101 is tubular and defines an internal bore 102 and other features discussed previously so as not to overly obstruct fluid flow through the wellhead 10B.

When the hanger 100 installs in the valve 50, the hanger's cross-port 106 communicates with the valve's cross-port 56, and seals 108*a-b* on the hanger 100 against the valve's bore 52. To hold the hanger 100, operators engage one or more lock screws 55 passing through the valve 50 into a circumferential groove 105 in the hanger 100 to lock the hanger 100 in place. Alternatively, the replacement master valve 50 can have a shoulder in its internal bore 52 on which the hanger 100 can land and one or more lock screws 55 can engage and retain the hanger 100.

As with the previous arrangement, the current hanger arrangement 12B can be used to fit almost any conventional wellhead. Although the stack height does not need to be changed in the current arrangement 12B, operators need to remove the Christmas tree of the wellhead 10B and use a replacement master valve 50. In some implementations, removing components may not be preferred so that another control line hanger arrangement disclosed herein may be used.

Figure 3:
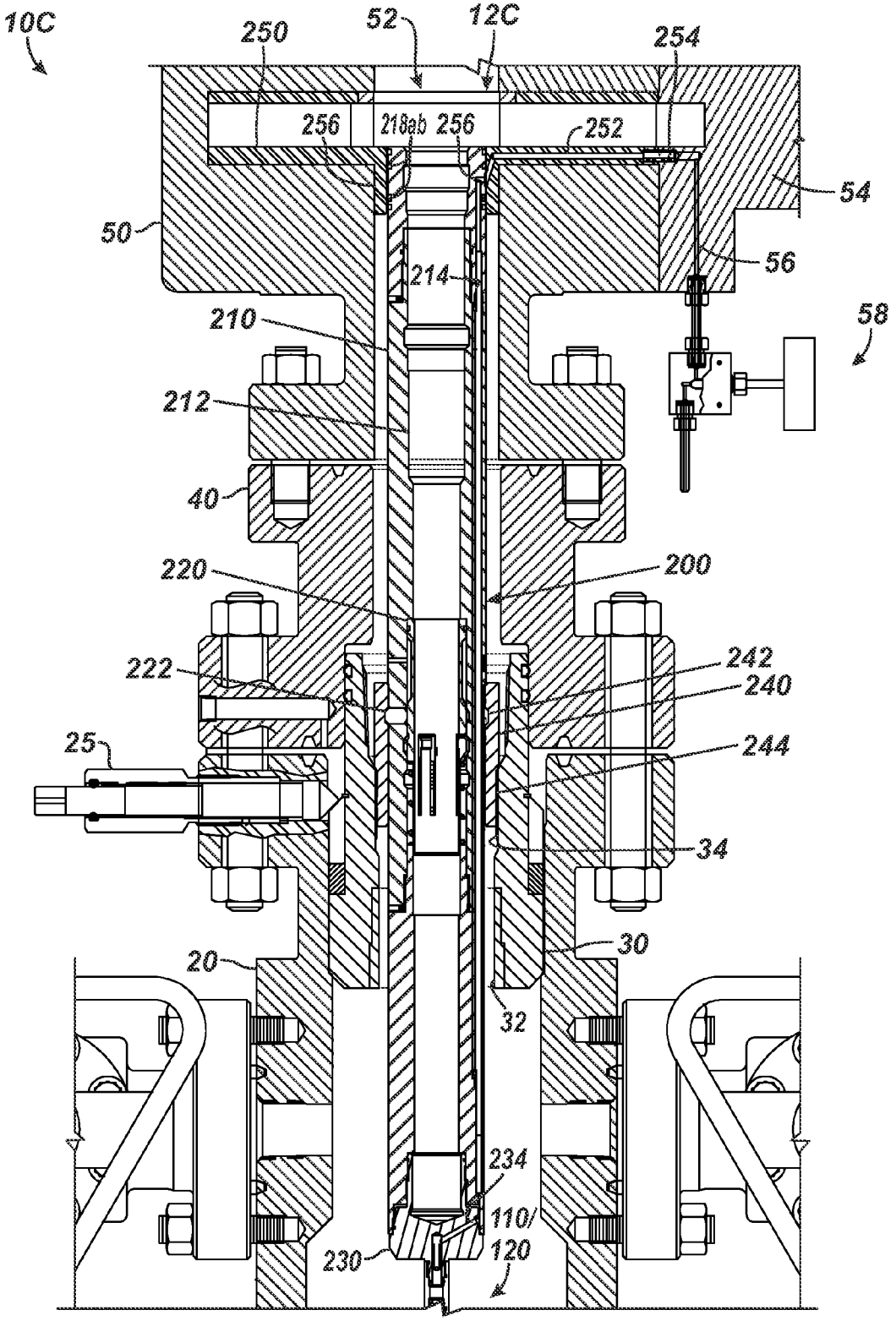
FIG. 3 illustrates a control line hanger arrangement where wellhead components do not need to be hot tapped or removed.

Turning to FIG. 3, another wellhead 10C has a control line hanger arrangement 12C for deploying a control line 120 without the need to hot tap components, change the stack height, or remove components of the wellhead 10C. Again, the wellhead 10C includes a tubing spool 20 in which a tubing hanger 30 is landed and is retained by a lock screw 25. A head adapter 40 attaches to the tubing spool 20 and seals against the top end of the tubing hanger 30, and a lower master valve 50 attaches above the head adapter 40.

The master valve 50 shown and disclosed elsewhere can be an expanding gate valve having gate, segment, spring, gate guides, seats, and the like. In addition, the master valve 50 can be a slab gate valve having gate, gate guides or retainer plates, seat rings, seal rings, and the like.

When a new control line 120 must be installed downhole for the various reasons outline previously, operators install an adapter sleeve 240 through the wellhead 100 and land it on the tubing hanger 30. The sleeve 240 can land in the hanger 30 in a number of ways. For example, the lower end of the sleeve 240 can be threaded and can thread onto the (back pressure valve) threads 34 in the tubing hanger's passage Alternatively, the lower end of the sleeve 240 can have a collet 244 that snaps into the threads 34 by force. The outside surface of the collet 244 can have slotted threads or collet fingers to engage the tubing hanger's threads 34. In some implementations, the sleeve 240 can be run in the through-bore of the wellhead 10C, and the collet 244 may fit into the hanger's passage 32 with about 400-lbs applied vertically to the sleeve 240 to snap the collet 244 in the tubing hanger 30. Preferably, the snap collet 244 is used so the sleeve 240 can be deployed by wireline and does not need to be turned to thread it into the hanger passage 32.

In addition, operators remove the bonnet of the master valve 50 and some of the internal gate components (not shown). Then operators install a new lower plate 250 in the master valve 50. (Depending on the type of master valve 50 used, this plate 250 can be a gate guide for an expanding gate valve, or it can be a retainer plate for a slab gate valve. Either way, reference to "retainer plate" is used herein to refer to such components in a gate valve.)

As shown, the new lower plate 250 has a central neck 256 that fits partially into the valve's bore 52. The plate 250 also defines a cross-port 252 that communicates from the perimeter or outside of the plate 250 to the plate's central neck 256. A nipple 254 can connect the outside inlet of the cross-port 252.

To accommodate the cross-port 252, the new lower plate 250 may have an increased thickness compared to the plate it replaces. Of course, this depends on how thick the original plate was and what size of cross-port 252 is desired. If the thickness of the plate 250 is increased, replacement or modified gate components (e.g., slap gate, slate gate and segment, etc.) for the master valve 50 may need to be used to fit into a decreased dimension in the valve 50. For example, the thickness of the gate used for the valve 50 may have to be reduced to account for the increased plate. These and other accommodations will be appreciated by one skilled in the art having the benefit of the present disclosure.

After reinstalling the gate components (such as slab gate or gate and segment), a replacement or modified bonnet 54 attaches to the valve 50. This bonnet 54 has a port 56 to which a valve 58 and communication line attach to communicate hydraulic. When the bonnet 54 fits on the valve 50, the bonnet's port 56 communicates with the nipple 254 so hydraulic fluid can be communicated to the cross-port 252 in the retainer plate 250.

Once the adapter sleeve 240 and retainer plate 250 are installed, the new control line 120 can be run downhole and supported in the wellhead 10A by a control line hanger 200. To install the hanger 200 and control line 120, the master valve 50 is opened, and the control line 120 is run through the bore 52. The hanger 200 is then made up to the end of the control line 120 after the line's length has been determined.

As shown, the hanger 200 has a tubular body 210 in which an internal sleeve 220 is movably disposed. A spring biases this internal sleeve 220 upward so that an outer profile of the sleeve 220 pushes lock dogs 222 (three of which may be used) through windows in the tubular body 210. Release can be achieved using an appropriate tool engaging collet fingers or other profile inside the internal sleeve 220.

The control line 120 connects to a lower nozzle portion or fluted connector 230 of the hanger 200 with a wet connector 110. This lower nozzle portion 230 has one or more channels or flutes (not shown) communicating with the body's internal passage 212 and has an internal passage or conduit 234 communicating with the hanger's passage 214. With the control line 120 connected, the hanger 200 is run into the wellhead 12C using standard wireline techniques. Eventually, the hanger 200 installs through the valve 50 and head adapter 40.

Eventually, when the control line 120 reaches the downhole valve, the control line hanger 200 reaches the sleeve 240. The spring biased locking dogs 222 on the hanger 200 engage in a circumferential lock profile 242 defined in the adapter sleeve 240 to hold the hanger 200 in place. Once seated, the control line hanger 200 carries the weight of the control line 120.

The seated hanger 200 also provides a conduit the control line fluid into the control line 120 and downhole to the safety valve or the like. At its upper end, for example, the hanger's inlet port 216 aligns adjacent the cross-port 252 of the valve's retainer plate 250. Seals 218*a-b* on the hanger 200 seal against the plate's central neck 256. From the inlet port 212, an internal passage 214 extends down through a wall of the hanger's body 210 to the outlet port 234 located in the lower nozzle portion 230.

One example for the hanger 200 is the Ren Gate control-line hanger available from Weatherford. Related details to such a hanger are disclosed in GB Application 0823558.2, filed 24 Dec. 2008 and entitled "Wellhead Downhole Line Communication Arrangement," as well as in D. Klompsma, "The Development of a System to Restore Full Safety Valve Functionality to Wells with Blocked and Damaged Control Line," SPE 123757 (2009), which are incorporated herein by reference in their entireties.

The collet 264 lands in the tubing hanger 30, and the control line hanger 200 lands in place in the sleeve 260. The outside of the control line hanger 200 can hold the fingers of the collet 264 outward and engaged with the tubing hanger 30. For retrieval, the control line hanger 200 is removed, and a retrieval tool is used to uninstall the snap collet 264 of the sleeve 260 from the tubing hanger 30.

As with the previous arrangements, the current hanger arrangement 12C can be used to fit almost any conventional wellhead. Moreover, the stack height does not need to be changed, and upper components of the wellhead 10C do not need to be removed. In some implementations, the central neck 256 of the retainer plate 250 may restrict the through-bore in the wellhead 10C so that a different hanger arrangement disclosed herein may be used.

Figure 4:
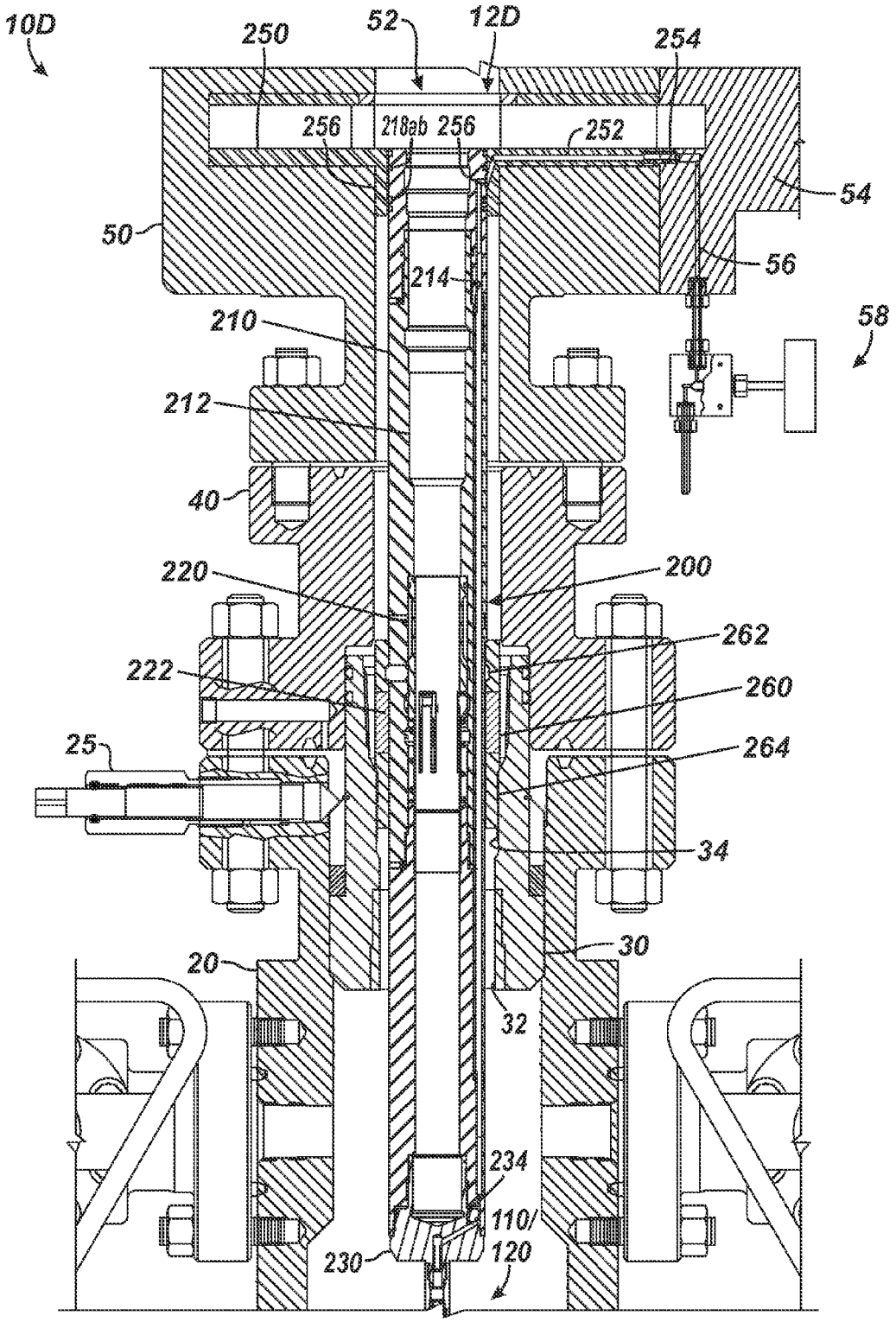
FIG. 4 illustrates another control line hanger arrangement where wellhead components do not need to be hot tapped or removed.

Typically, a height between the tubing hanger 30 and the master valve 50 needs to be known so that the hanger 200 can be properly sized to fit between the sleeve 240 and plate 250 in the arrangement 10C of FIG. 3. To do this, operators need to refer to the layout of the wellhead 10C for proper dimensions. As an alternative, FIG. 4 shows another control line hanger arrangement 12D for a wellhead 10D. This arrangement 10D uses an adjustable adapter sleeve 260, which is shown in an isolated view in FIG. 5A. Because the sleeve 260 is adjustable, it is useful in situations where the height between the hanger 30 and master valve 50 cannot be sufficiently determined or may vary from what is originally expected.

Again, the wellhead 10D includes a tubing spool 20 in which a tubing hanger 30 is landed and is retained by a lock screw 25. A head adapter 40 attaches to the tubing spool 20 and seals against the top end of the tubing hanger 30, and a lower master valve 50 attaches above the head adapter 40.

When a new control line 120 must be installed downhole for the various reasons outline previously, operators install the adjustable adapter sleeve 260 through the wellhead 10D and land it on the tubing hanger 30. As noted previously, the sleeve 260 can land on the hanger 30 in a number of ways. Preferably, the lower end of the sleeve 260 has a collet 264 that snaps into the threads 34 of the hanger's passage 32 by force. The three piece adapter (260) is held by cap screws.

As before, operators remove the bonnet of the master valve 50 and its internal gate components (not shown). Then, operators install a new lower retainer plate 250 with a cross-port 252 and central neck 256 in the master valve 50. After reinstalling the gate components (not shown), a replacement or modified bonnet 54 attaches to the valve 50 and has a port 56 to which a valve 58 and communication line attach for hydraulic fluid.

Once the adapter sleeve 260 and retainer plate 250 are installed, the new control line 120 can be run downhole and supported in the wellhead 10D by the hanger 200, which is similar to that described previously. Because the hanger's spring-loaded dogs 222 engage in the circumferential lock profile 262 in the sleeve 260 and the end of the hanger 200 fits near the retainer plate 250, it is important that the dimensions of the sleeve 260 and hanger 200 are accurately machined so that portion of the hanger 200 does not extend into the master valve 50 or the port 216 does not misalign with the plate's cross-port 252. To help with installation in the field, the sleeve 260 is adjustable as noted previously and described in more detail below.

Figure 5A:
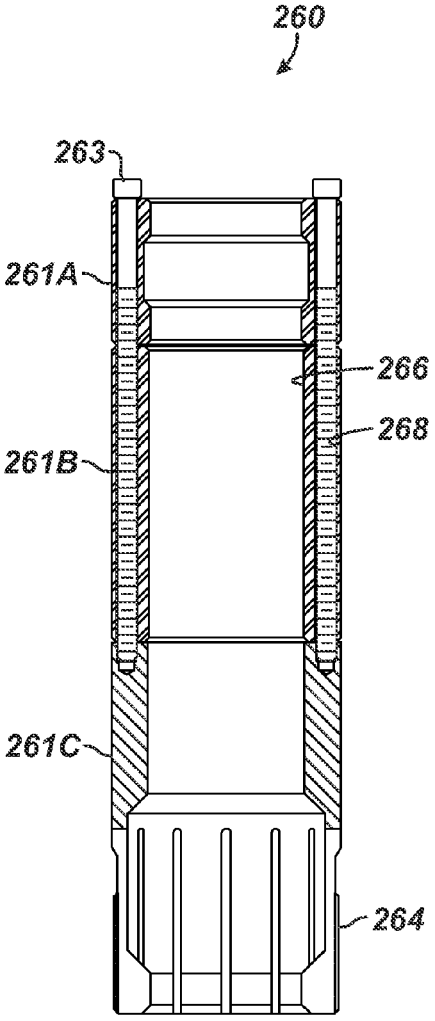
FIGS. 5A-5B illustrates the adapter sleeve of FIG. 4.
Figure 5B:
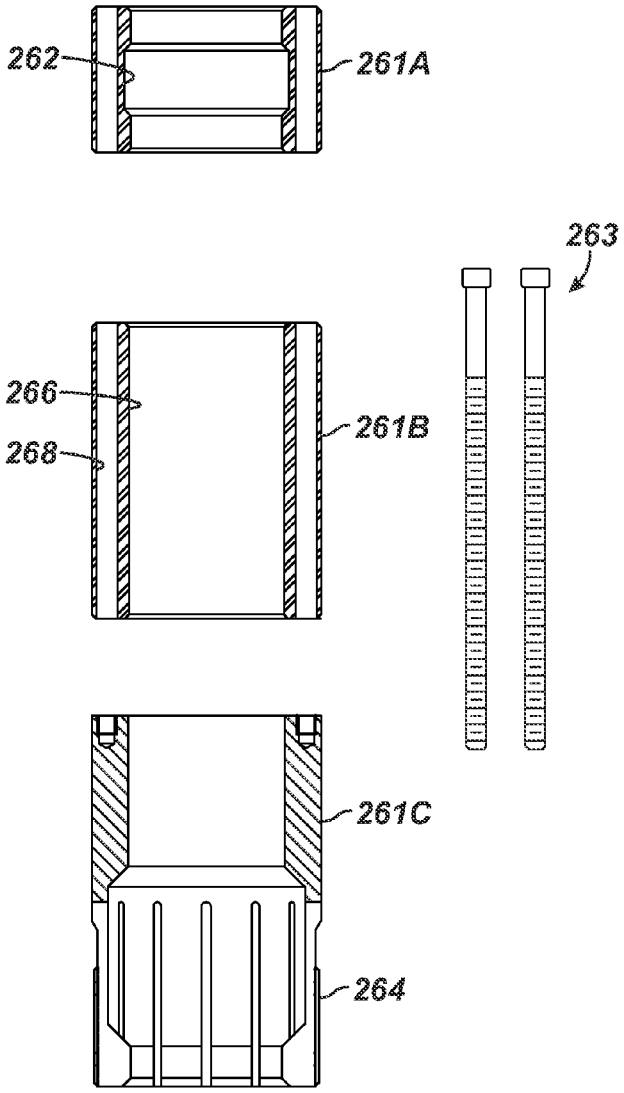

As shown in FIGS. 5A-5B, the sleeve 260 has several stackable elements 261A-C. A plurality of cap screws 263 pass through holes around the perimeters of the elements 261A-C to affix them together. Each element 261A-C defines an internal passage therethrough so that the hanger (200) can be installed therein.

The lower element 261C has the collet 264 for installing in the tubing hanger (30). The upper element 261A defines the lock profile 262 for locking the lock dogs (222) of the hanger (200) therein. The intermediate element 261B can have a variable length to adjust the overall height of the sleeve 260 (and hence the distance between the collet 264 and lock profile 262.

Height adjustment can be achieved in a number of ways. For example, several intermediate elements 261B can be pre-configured with particular heights so that they can be interchanged as needed in the field to adjust the overall height of the sleeve 260. Alternatively, the intermediate element 261B can be cut laterally to adjust its height in the field based on the current needs at an installation. This can be done with existing equipment at the site.

To determine the proper adjustment needed, operators can install the sleeve 260 unaltered into the wellhead 10D. Again, this can be done by wireline and forcing the collet 264 into the thread 34 of the tubing hanger 30. Next, operators can install the control line hanger 200 in the sleeve 260 measure what length of the hanger 200 extends above the lower retainer plate 250 into the master valve 50. Removing the components and disconnecting the sleeve's elements 261A-C, operators can then remove the excess length from the intermediate element 261B. The sleeve 260 can then be reassembled and used so that the control line hanger 200 will not extend into the master valve 50.

Although shown having three elements 261A-C, the sleeve 260 could have two elements—one with the lock profile 262 and one with the collet 264. Intermediate ends of either one or both of these elements could be cut to adjust the overall height of the sleeve.

To remove uncertainty of the distance between the master valve 50 and the tubing hanger 30, operators can use one of the other arrangements disclosed herein. Moreover, operators may use an arrangement that eliminates the need to support components on the tubing hanger 30 altogether so that distances do not need to be determined and the threads 34 of the hanger 30 are not exposed to mechanical damage.

Figure 6:
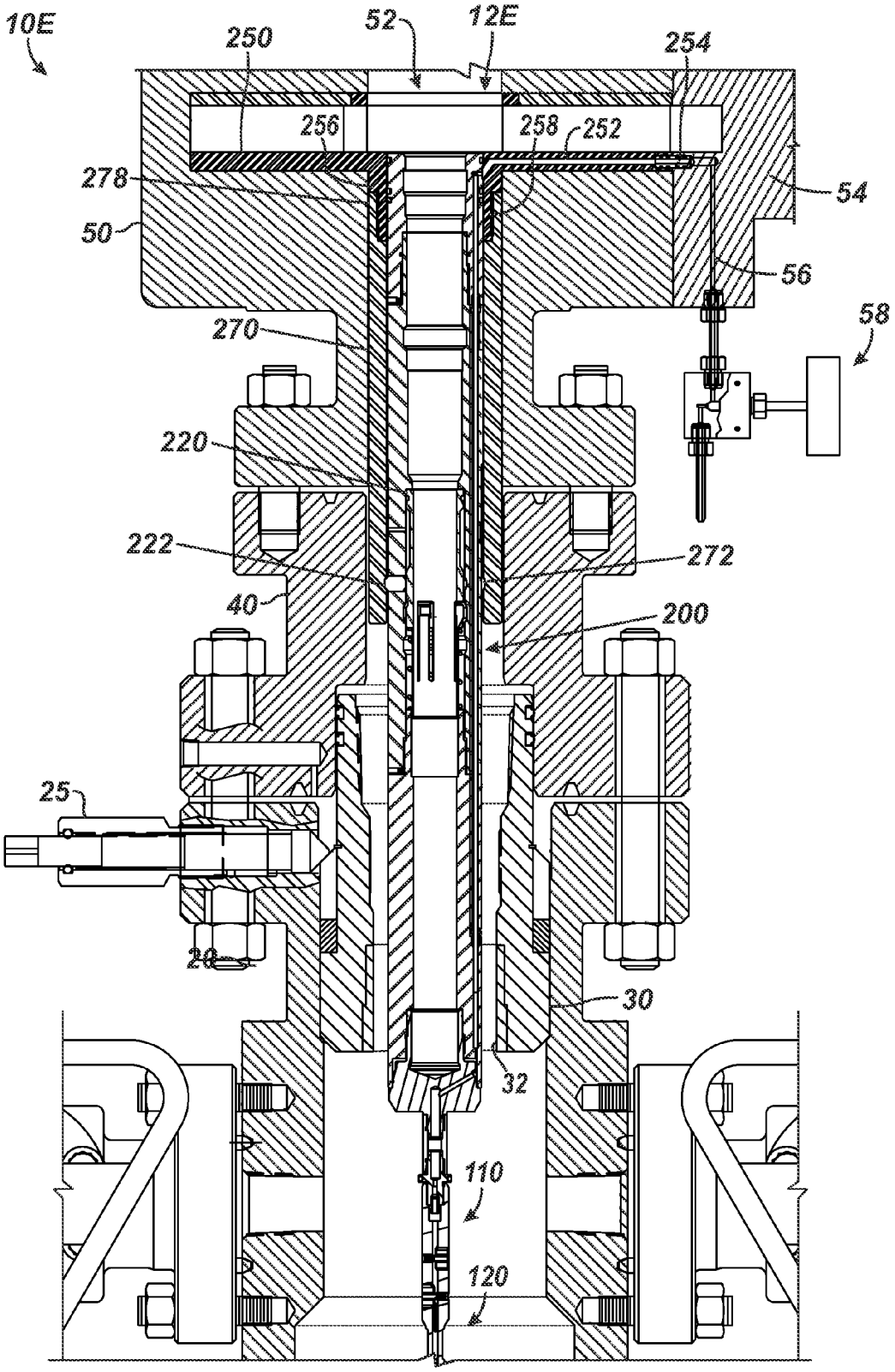
FIG. 6 illustrates a control line hanger arrangement where the tubing hanger is not used to support the hanger.

For example, FIG. 6 shows another control line hanger arrangement 12E for a wellhead 10E. This arrangement 10E uses a sleeve 270 of known length that fits from the end of a retainer plate 250 in the master valve 50. Again, the wellhead 10E includes a tubing spool 20 in which a tubing hanger 30 is landed and is retained by lock screws 25. A head adapter 40 attaches to the tubing spool 20 and seals against the top end of the tubing hanger 30, and a lower master valve 50 attaches above the head adapter 40.

When a new control line 120 must be installed downhole for the various reasons outline previously, operators install a retainer sleeve 270 through the bore 52 of the master valve 50. As before, operators then install a retainer plate 250 into the master valve 50 by removing the existing bonnet and other steps outlined previously. Again, this retainer plate 250 defines a cross-port 252 for communicating from a nipple 254 to outlet port through the plate's central neck 256.

In contrast to previous arrangements, the retainer sleeve 270 attaches to the retainer plate 250 rather than resting in the tubing hanger. In particular, the central neck 256 can have a threaded portion 258 that threads to the end of the retainer sleeve 270. Other forms of attachment could also be used.

Once assembled, the retainer plate 250 sits inside the master valve 50, and the retention sleeve 270 extends down through the valve's bore 52 and into the head adapter 40. Although shown as a unitary piece, the retention sleeve 270 could have two or more parts and could be adjustable as with previous arrangements.

The rest of the assembly process can proceed as described previously. Therefore, operators can make up the control line 120 to the control line hanger 200 and run them in the through-bore of the wellhead 10E. The hanger 200 fits into the sleeve 270, and the spring-biased dogs 222 engage in the lock profile 272 of the sleeve 270. Because the distance between the profile 272 and inlet port of the plate's cross-port 252 is known and configurable, the appropriately sized hanger 200 can fit in the sleeve 270 without a portion extending beyond the plate 250 into the master valve 50. Therefore, operators can install the control line hanger 200 as before and engage the dogs 222 in the profile 272 without needing to make modifications.

Figure 7:
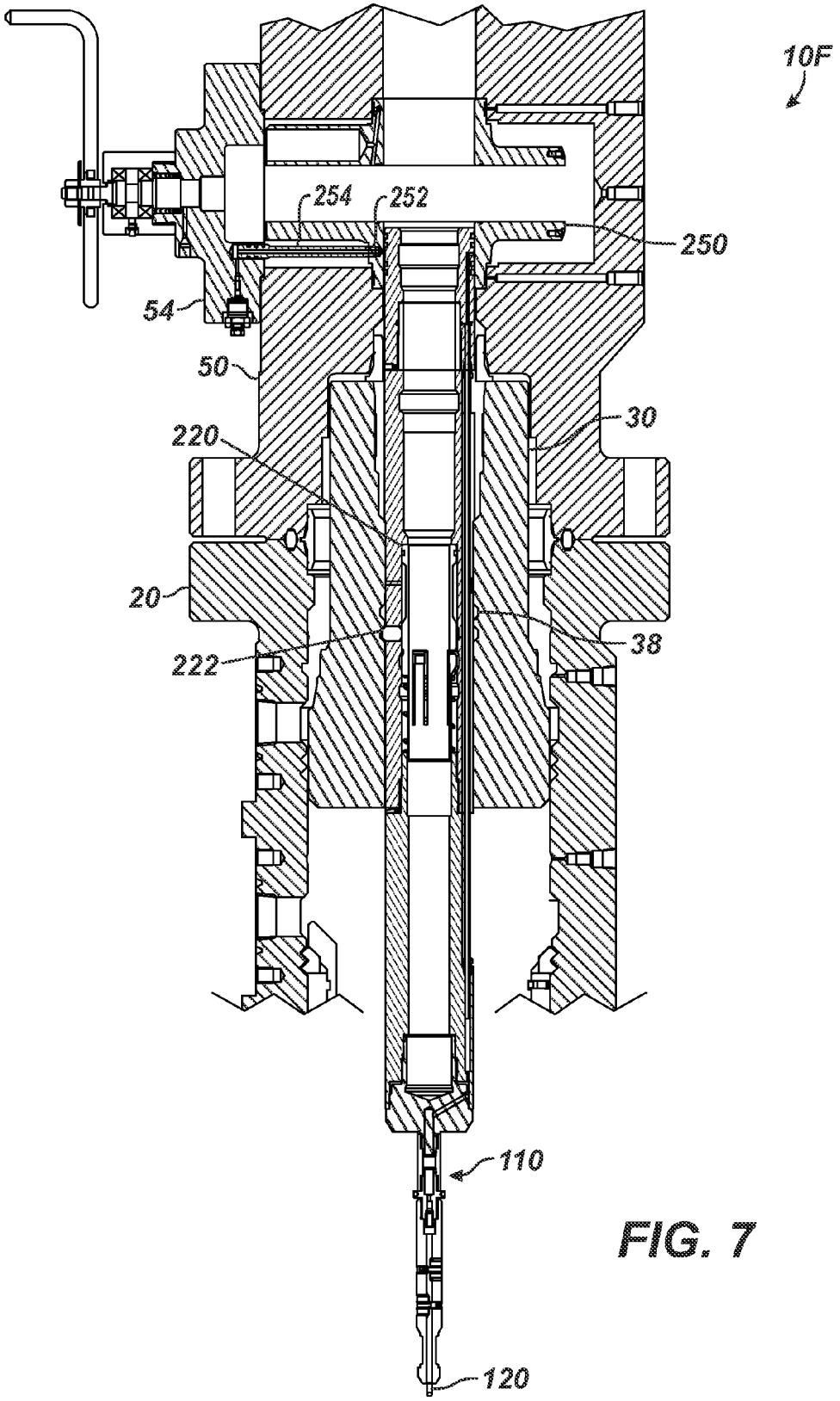
FIG. 7 illustrates a control line hanger arrangement where an adapter sleeve is not used.

In some implementations, it is desirable to not use a sleeve or other device to support a control line hanger in a wellhead because the sleeve tends to reduce the through-bore of the wellhead. Therefore, in some implementations, the control line hanger can land directly in the tubing hanger 30. In the arrangement 12F of FIG. 7, the control line hanger 200 lands in the tubing hanger 30.

In this arrangement, operators remove the lower retainer plate and existing bonnet for the master valve and replace the removed plate with another plate 250 having an inlet port 252. Operators then replace the bonnet with a new or replacement bonnet 54 having a port 56. A nipple 254 connects from the bonnet's port 56 to the plate's port 252. The control line 120 connects to the hanger 200 as before, and they are passed into the through-bore of the wellhead 10F. Eventually, the lock dogs 222 on the hanger 200 lock into a profile 38 defined in the tubing hanger 30. This profile 38 can be for a backpressure valve or the like. The hanger's passage 214 communicates with the port 252 in the plate 250 so hydraulic fluid can be communicated to the control line 120.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wellhead control line deployment apparatus supporting a control line below a valve mechanism of a wellhead and through a head adapter and a casing head of the wellhead, the apparatus comprising:

a wellhead component installing above the head adapter and the casing head on the wellhead, the wellhead component having a first bore and having at least one lock screw disposed in a side of the first bore, the wellhead component having a first port communicating the first bore outside the wellhead component; and a control line hanger installing at least partially in the first bore of the wellhead component, the at least one lock screw engaging the control line hanger when installed therein, the control line hanger having a hanger body defining a second bore from a first end to a second end, the hanger body having a second port with an inlet and an outlet, the inlet communicating with the first port on the component; and a connector connected to the control line, the connector supported on the second end of the hanger body and connecting the outlet of the hanger body to the control line, wherein the connector hangs the control line along an axis of the second bore and defines one or more flutes for communicating flow therethrough.

2. The apparatus of claim 1, wherein the wellhead component comprises an adapter spool installed on the head adapter and supporting a master valve having the valve mechanism thereabove.

3. The apparatus of claim 1, wherein the wellhead component comprises a master valve having the valve mechanism and installed on the head adapter.

4. The apparatus of claim 1, wherein the control line hanger comprises first and second annular seals disposed thereabout, the first and second annular seals having the inlet of the second port disposed therebetween and engaging an internal wall of the first bore of the wellhead component.

5. The apparatus of claim 1, wherein the wellhead component defines a first shoulder in the first bore, and wherein the hanger body defines a second shoulder engaging the first shoulder when installed in the wellhead component.

6. The apparatus of claim 5, wherein the second shoulder is disposed thereabout between the first and second ends of the hanger body.

7. The apparatus of claim 5, wherein the at least one lock screw engages the first end of the control line hanger.

8. The apparatus of claim 1, wherein the hanger body defines a groove disposed between the first and second ends, the at least one lock screw engaging in the groove of the control line hanger installed in the wellhead component.

9. The apparatus of claim 1, wherein the connector comprises a wet mate connector supported by fluted connector arms to the second end of the hanger body.

10. The apparatus of claim 9, wherein the connector comprises a conduit connecting the outlet of the second port with the wet mate connector.

11. A method of supporting a new control line at a wellhead to a downhole tool, the wellhead having a casing head, a head adapter, and a master valve disposed on top of one another, the method comprising:

removing the master valve from the head adapter of the wellhead;

installing a wellhead component on the head adapter of the wellhead, the wellhead component having a side port communicating a first internal bore outside the wellhead component;

connecting a control line to a control line hanger by supporting a wet mate connector with fluted connector arms to an end of the control line hanger, the control line hanger having a second internal bore, the control line hanger communicating the control line to an inlet port on the control line hanger;

disposing the control line and the control line hanger in a through-bore of the wellhead;

landing the control line hanger at least partially in the wellhead component; and communicating the inlet port of the control line hanger with the side port of the wellhead component.

12. The method of claim 11, wherein landing the control line hanger at least partially in the wellhead component comprises engaging an external shoulder on the control line hanger on an internal shoulder of the first internal bore of the wellhead component.

13. The method of claim 11, wherein landing the control line hanger at least partially in the wellhead component comprises engaging the control line hanger with a lock screw on the wellhead component.

14. The method of claim 13, wherein engaging the control line hanger with the lock screw on the wellhead component comprises engaging an upper edge of the control line hanger or an external groove on the control line hanger with the lock screw.

15. The method of claim 11, wherein landing the control line hanger at least partially in the wellhead component comprises engaging first and second annular seals disposed about the control line hanger above and below the inlet port against the first internal bore of the wellhead component.

16. The method of claim 11, wherein installing the wellhead component on the head adapter of the wellhead comprises:

installing the wellhead component as an adapter spool on the head adapter of the wellhead, the adapter spool having the side port communicating the first internal bore outside the adapter spool; and installing the master valve on the adapter spool.

17. The method of claim 11, wherein installing the wellhead component on the head adapter of the wellhead comprises:

installing the wellhead component as a new mater valve on the head adapter of the wellhead, the new master valve having the side port communicating the first internal bore outside the new master valve.

18. The method of claim 11, wherein connecting the control line to the control line hanger comprises connecting a conduit between the wet mate connector and an outlet port on the control line hanger.

* * * * *